US012728308B2

(12) United States Patent
Liu

(10) Patent No.: US 12,728,308 B2
(45) Date of Patent: Sep. 8, 2026

(54) MULTIFUNCTIONAL FITNESS EQUIPMENT

(71) Applicant: Bin Liu, Ningbo (CN)

(72) Inventor: Bin Liu, Ningbo (CN)

( * ) Notice: Subject to any disclaimer, the term of this patent is extended or adjusted under 35 U.S.C. 154(b) by 0 days.

(21) Appl. No.: 18/379,664

(22) Filed: Oct. 13, 2023

(65) Prior Publication Data

US 2025/0121246 A1 Apr. 17, 2025

(51) Int. Cl.
*A63B 21/00* (2006.01)
*A63B 21/062* (2006.01)

(52) U.S. Cl.
CPC ..... *A63B 21/154* (2013.01); *A63B 21/0626* (2015.10); *A63B 21/4035* (2015.10); *A63B 2225/093* (2013.01)

(58) Field of Classification Search
CPC ..... A63B 21/0626; A63B 21/0724; A63B 21/0783; A63B 21/154; A63B 21/4035; A63B 23/0355; A63B 23/03558; A63B 23/04; A63B 23/0405; A63B 23/12; A63B 23/1218; A63B 2023/0411; A63B 71/0054; A63B 2071/0072; A63B 2071/0081; A63B 2225/09; A63B 2225/093; A63B 2225/10; A63B 2244/09
See application file for complete search history.

(56) References Cited

U.S. PATENT DOCUMENTS

| | | | | |
|---|---|---|---|---|
| 6,685,601 | B1 * | 2/2004 | Knapp | A63B 21/0783 482/142 |
| 12,059,587 | B2 * | 8/2024 | Gore | A63B 21/0783 |
| 2003/0027695 | A1 * | 2/2003 | Lee | A63B 23/00 482/99 |
| 2013/0274075 | A1 * | 10/2013 | Habing | A63B 21/0628 482/102 |
| 2020/0114196 | A1 * | 4/2020 | Habing | A63B 23/03566 |
| 2024/0042262 | A1 * | 2/2024 | Meredith | A63B 21/0628 |
| 2024/0189650 | A1 * | 6/2024 | Xiao | A63B 21/156 |

FOREIGN PATENT DOCUMENTS

| | | | | |
|---|---|---|---|---|
| KR | 102337665 | B1 * | 12/2021 | A63B 21/078 |
| KR | 20230000671 | U * | 4/2023 | A63B 71/0054 |
| KR | 102528720 | B1 * | 5/2023 | A63B 21/072 |

* cited by examiner

*Primary Examiner* — Gary D Urbiel Goldner
(74) *Attorney, Agent, or Firm* — Jose Cherson Weissbrot

(57) ABSTRACT

A multifunctional fitness equipment comprises a frame assembly, a drive assembly, a slide car, and a smith machine. The frame assembly includes two base frames set opposite to each other and connected by a connecting rod. A first column and a second column are connected by a gantry frame and are set in the vertical direction relative to the connecting rod. A first cross beam and a second cross beam are set horizontally on the connecting rod and the gantry frame, respectively, and a third column is set between them, thus forming a structure of the fitness equipment. A pulley assembly cooperates with a first wire rope, a second wire rope, and a third wire rope to drive movement of the slide car, achieving routing from a middle of the structure of the fitness equipment, reducing friction and increasing service life of the multifunctional fitness equipment when in use.

20 Claims, 14 Drawing Sheets

MULTIFUNCTIONAL FITNESS EQUIPMENT

TECHNICAL FIELD

The present invention relates to the technical field of fitness equipment, and in particular relates to a multifunctional fitness equipment.

BACKGROUND

The current market for fitness equipment is vast, as its functions in physical fitness, muscle building, shaping, and more are loved by the majority of people. However, traditional fitness equipment routes the wire rope from both sides, which not only results in a long path but also involves the wire rope connection with cumbersome steps and consumes more materials in use. The friction between the wire rope and the slide car is too great, resulting in greater wear to the fitness equipment and, a shorter fitness equipment service life. In addition, the traditional fitness equipment uses many pulleys, which not only consumes materials but also makes the installation steps cumbersome and very inconvenient. Moreover, traditional fitness equipment has only a single function, resulting in low utilization rates. This is very inconvenient, and the single function of traditional fitness equipment greatly limits the diversification of the user's fitness actions.

Based on the above problems, it is necessary to provide a brand-new fitness equipment which is easy to install, saves materials, reduces wear and tear with a longer service life during use. In addition, the fitness equipment should have more functions, so that the user can perform more fitness actions by using the fitness equipment.

SUMMARY

The present invention provides a multifunctional fitness equipment comprising a frame assembly, a drive assembly, a slide car and a smith machine.

The frame assembly comprises two base frames, a first column and a second column set opposite to each other on the left and right, the two base frames being connected by a connecting rod, the first column and the second column being set vertically, the upper end portions of the first column and the second column being connected to each other by a gantry frame, a support frame is provided between the first column and the second column and the two base frames, the connecting rod being provided with a relatively perpendicular first cross beam, and the gantry frame being provided with a relatively perpendicular second cross beam, wherein the first cross beam and the second cross beam are set opposite to each other on the same side; and the third column is provided between the first cross beam and the second cross beam; and a frame of the fitness equipment is formed by the above-mentioned structural connections.

The drive assembly comprises a pulley assembly, and with the pulley assembly includes a first wire rope, a second wire rope and a third wire rope. The first wire rope merges from both sides, extending toward the center, the pulley assembly is connected to the second wire rope and the third wire rope, respectively, the first wire rope drives the movement of the second wire rope and the third wire rope, in order to drive the slide car to slide up and down, the wire rope routing path aligns from the center, which is relatively shorter than routing from both sides making the wire rope installation simpler and saves materials.

The smith machine includes a cross bar, a fourth riser, and a smith pole, the cross bar being set relative to the rear end of the first column and the upper portion of the second column, the fourth riser is set opposite to the cross bar and the base frame, wherein the fourth riser is provided with a pole mount and a telescopic positioning seat, and the smith pole is disposed on the pole mount.

BRIEF DESCRIPTION OF DRAWINGS

In order to explain the technical solution of this application more clearly, the drawings needed for the embodiments will be briefly introduced below. Obviously, the drawings described below are only some embodiments of this application. For those skilled in the art, other drawings can be obtained based these drawings without creative effort.

In the drawings.

Figure 1:
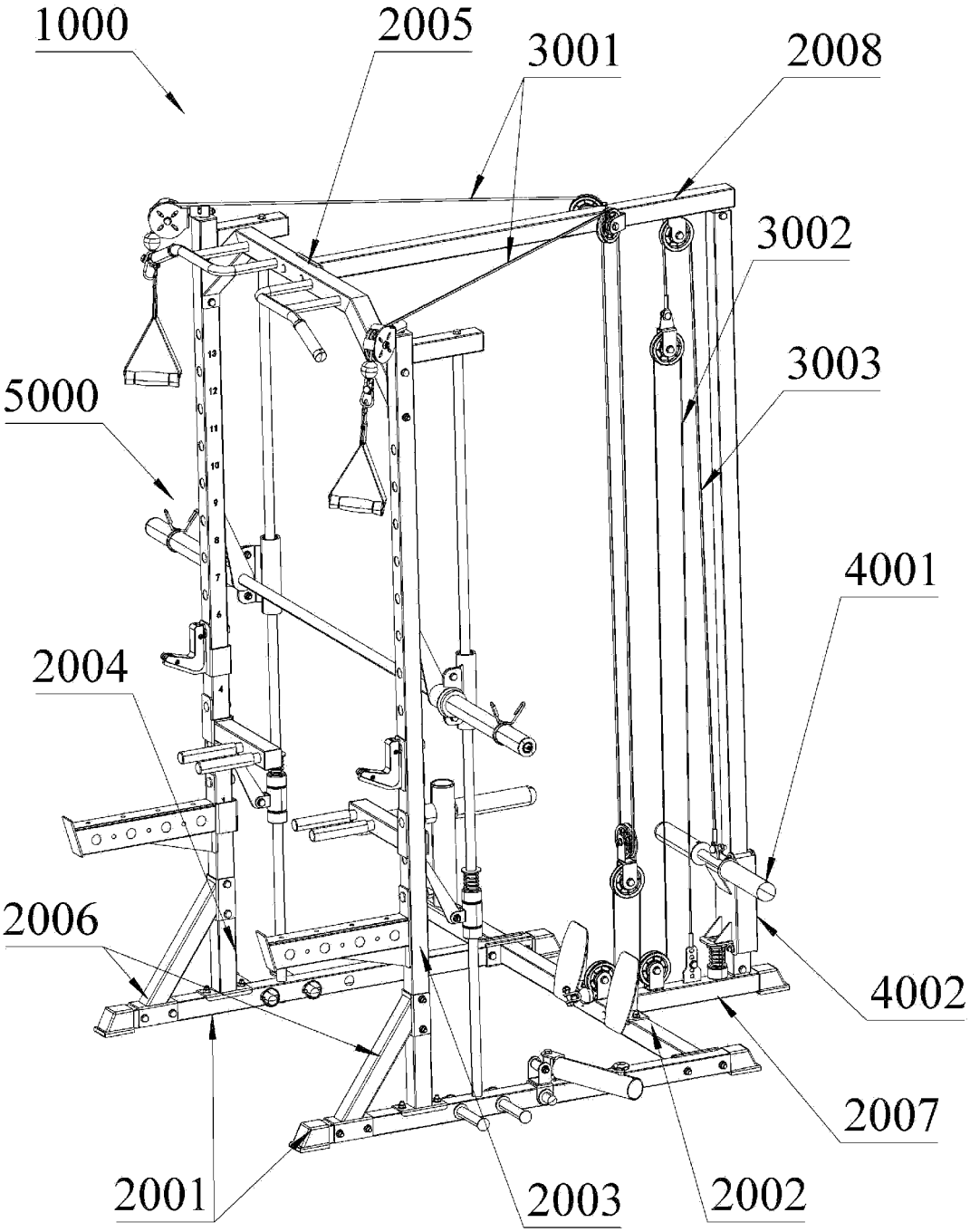
FIG. 1 shows a schematic view of the overall structure of the fitness equipment.

1000, multifunctional fitness equipment; 2000, frame assembly; 2001, base frame; 2002, connecting rod; 2003, first column; 2004, second column; 2005, gantry frame; 2006, support frame; 2007, first cross beam; 2008, second cross beam; 2009, third column; 2010, mounting holes; 2011, gun barrel; 2012, pedals; 2013, olympian barrel; 2014, first side shelf; 2015, positioning holes; 2016, second side shelf; 2017, cylindrical bar; 2018, handles; 3000, drive assembly; 3001, first wire rope; 3002, second wire rope; 3003, third wire rope; 3004, first pulley; 3005, second pulley; 3006, third pulley; 3007, fourth pulley; 3008, fifth pulley; 3009, sixth pulley; 3010, seventh pulley; 3011, eighth pulley; 3012, ninth pulley; 3013, tenth pulley; 3014, first bearing; 3015, connecting shaft; 3016, sliding groove; 3017, first limiting ball; 3018, second limiting ball; 3019, puller; 3020, third limiting ball; 3021, snap; 3022, wire rope connection seat; 4000, slide car; 4001, trolley bracket; 4002, sliding seat; 4003, elastic limit seat; 4004, roller column; 4005, second bearing; 4006, through-hole; 4007, limit block; 4008, mounting block; 4009, mounting post; 4010, spring; 4011, limiting piece; 5000, smith machine; 5001, cross bar; 5002, fourth riser; 5003, smith pole; 5004, pole mount; 5005, telescopic positioning seat; 5006, first positioning hook plate; 5007, second positioning hook plate; 6000, pull-up bar; 7000, chain.

DESCRIPTION OF EMBODIMENTS

In describing the preferred embodiments, specific terminology will be used for the sake of clarity. It is to be understood that each specific term includes all technical equivalents that operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the inventive concept.

It will be understood that when an element or layer is referred to as being "on." "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates otherwise.

The present invention provides a multifunctional fitness equipment 1000, as shown in FIG. 1. The multifunctional fitness equipment 1000 includes a frame assembly 2000, a drive assembly 3000, a slide car 4000 and a smith machine 5000.

Figure 2:
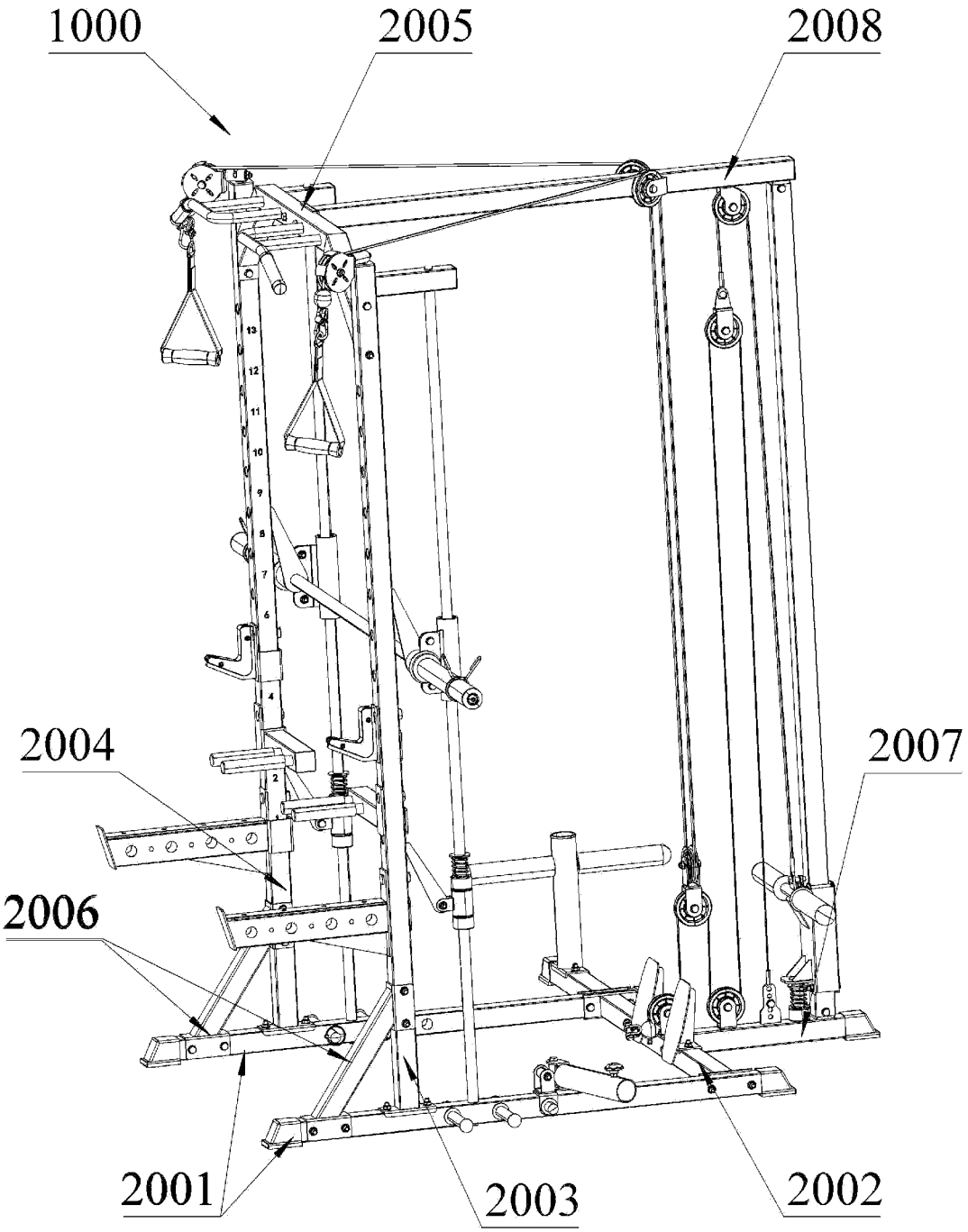
FIG. 2 shows a schematic view of the structure of the frame assembly of the fitness equipment.

In this embodiment, as shown in FIG. 2, the frame assembly 2000 comprises a plurality of base frames 2001, a first column 2003 and a second column 2004. The plurality of base frames 2001 comprises a first base frame and a second base frame. The first base frame and the second base frame are placed opposite to each other and each of the plurality of the base frames 2001 are connected to each other by a connecting rod 2002. The first column 2003 is connected to the first base frame by standing vertically on the first base frame. The second column 2004 is connected to the second base frame by standing vertically on the second base frame. The first column 2003 and the second column 2004 are standing vertically opposite to each other. The first column 2003 and the second column 2004 are connected to each other by a gantry frame 2005, wherein the first column 2003, the second column 2004 and the plurality of the base frame 2001 bracket are provided with a support frame 2006, which forms a triangular structure, enhancing the structural strength of the multifunctional fitness equipment 1000 and making the multifunctional fitness equipment 1000 resistible to tipping over. The frame assembly 2000 further comprises a first cross beam 2007 and a second cross beam 2008. The first cross beam 2007 and the second cross beam 2008 are disposed opposite to each other on the same side, wherein the first cross beam 2007 and the second cross beam 2008 are connected to a third column 2009, to form a frame of the multifunctional fitness equipment 1000 by the above-mentioned structural connections. The frame of the multifunctional fitness equipment 1000 has an overall triangular structure with strong stability.

Figure 3:
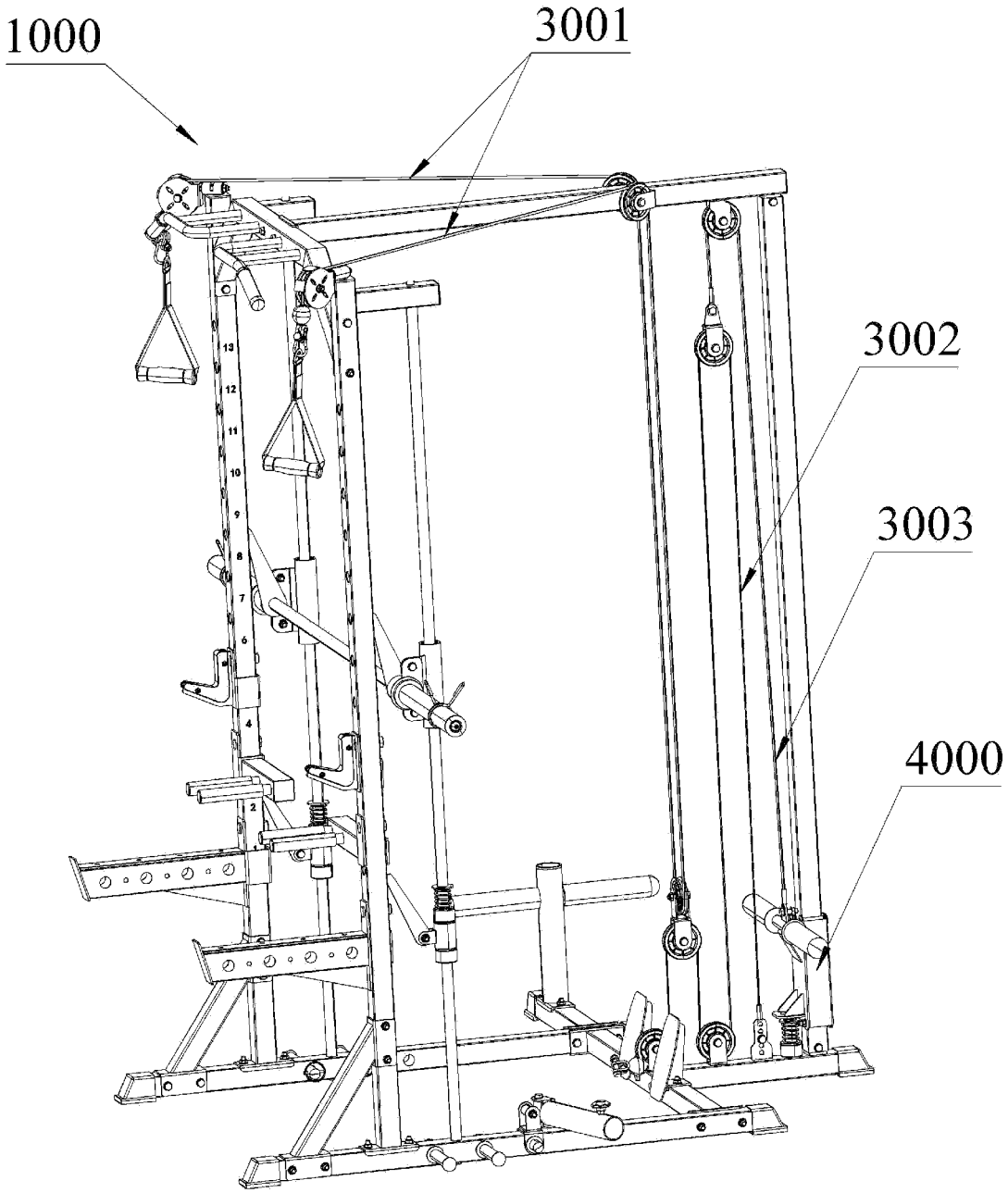
FIG. 3 shows a schematic view of the structure of the drive assembly of the fitness equipment.

In this embodiment, as shown in FIG. 3, the drive assembly 3000 includes a pulley assembly, a first wire rope 3001 and a second wire rope 3002. The drive assembly 3000 includes a third wire rope 3003 used with the pulley assembly. The first wire rope 3001 extends backward from two sides to the center and merges, the pulley assembly is the second wire rope 3002 and the third wire rope 3003, respectively. The pulley assembly is connected to the second wire rope 3002 and the third wire rope 3003, and the first wire rope 3001 drives the second wire rope 3002 and the third wire rope 3003 to move, thereby driving the slide car 4000 to slide up and down. The wire rope alignment path is from the center of the wire, compared to the alignment from the two sides of the wire, the path is relatively short, so that the wire rope is connected to the installation of the wire rope is relatively simple and saves material.

Figure 4:
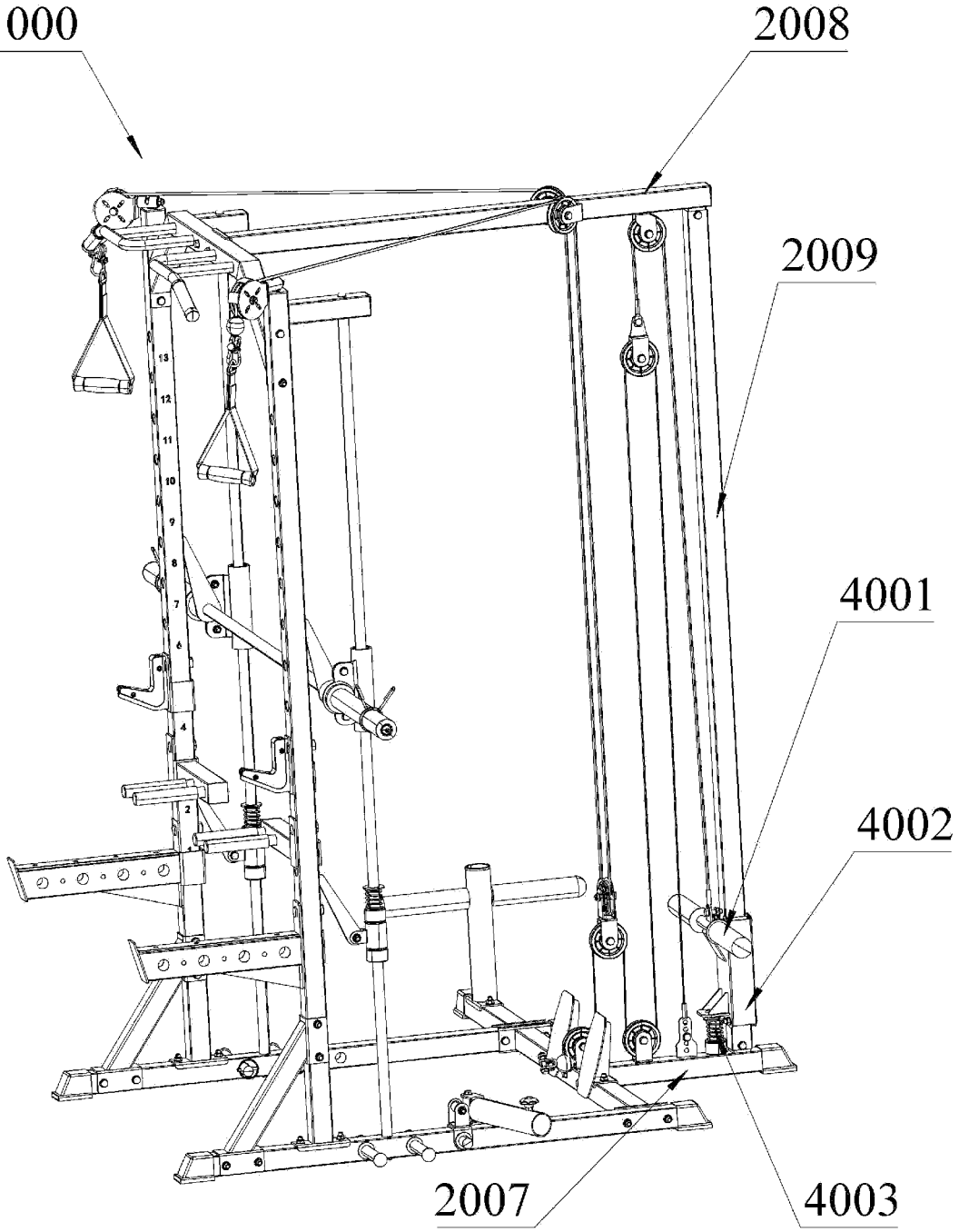
FIG. 4 shows a schematic view of the structure of the slide car of the fitness equipment.

In this embodiment, as shown in FIG. 4, the slide car 4000 further includes a trolley bracket 4001, a sliding seat 4002, and an elastic limit seat 4003. The trolley bracket 4001 slides up and down along the third column 2009 via the sliding seat 4002. The elastic limit seat 4003 is connected between the first cross beam 2007 and the sliding seat 4002, to limit the sliding position of the trolley bracket 4001 via the elastic limit seat 4003, wherein the trolley bracket 4001 is braced on the sliding seat 4002 through the support component, giving the trolley bracket 4001 a stable structure with the sliding seat 4002. The trolley bracket 4001 and the sliding seat 4002 are connected to form a bird like anti-collision structure, which reduces the structural area of the fitness equipment base, as well as effectively improves the anti-collision ability. In other embodiments (not shown in the figures), the trolley bracket 4001 may also be provided with a counterweight block to increase the exercise intensity. In this embodiment, the length of the first cross beam 2007 is less than the length of the second cross beam 2008.

Figure 5:
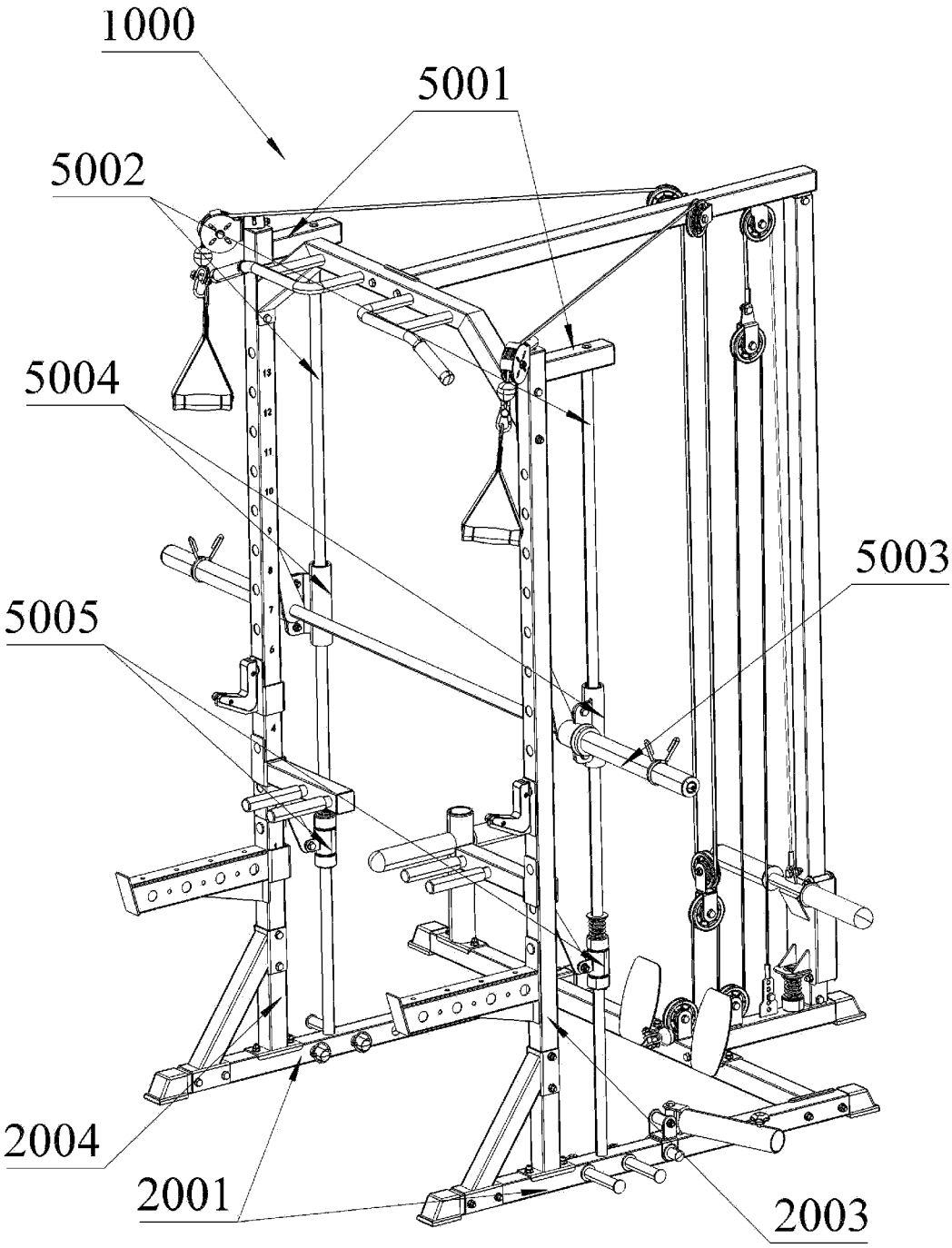
FIG. 5 shows a schematic view of the structure of the smith machine of the fitness equipment.

In this embodiment, as shown in FIG. 5, the smith machine 5000 includes a cross bar 5001, a fourth riser 5002, and a smith pole 5003. The cross bar 5001 is set relative to the rear end of the upper portion of the first column 2003 and the second column 2004. The fourth riser 5002 is set relative to each other between the cross bar 5001 and the base frame 2001, wherein the fourth riser 5002 is provided with a pole mount 5004 and a telescopic positioning seat 5005. The smith pole 5003 is provided on the pole mount 5004, wherein the pole mount 5004 and the telescopic positioning seat 5005 are movable up and down, and there is a smith pole 5003 configured in the pole mount 5004, wherein the smith pole 5003 is operated by the telescopic positioning seat 5005 so as to perform training.

Figure 6:
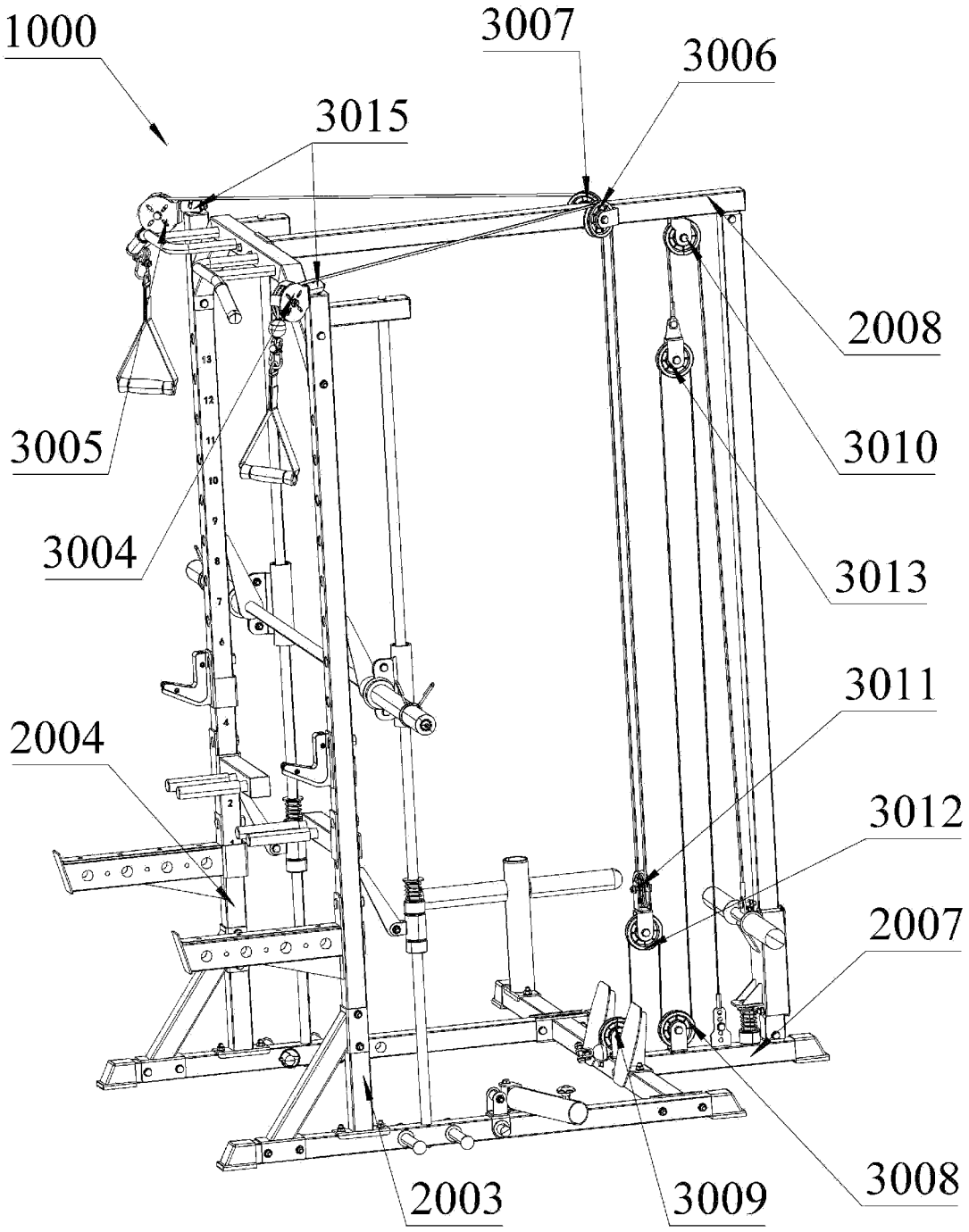
FIG. 6 shows a schematic view of the connection structure of the pulley assembly.

In this embodiment, as shown in FIG. 6, the pulley assembly includes a first pulley 3004, a second pulley 3005, a third pulley 3006, a fourth pulley 3007, a fifth pulley 3008, a sixth pulley 3009, a seventh pulley 3010, an eighth pulley 3011, a ninth pulley 3012, and a tenth pulley 3013.

The first pulley 3004 is mounted obliquely and symmetrically on one side of the first column 2003 via a connecting shaft 3015.

The second pulley 3005 is mounted diagonally and symmetrically on one side of the second column 2004 by the connecting shaft 3015.

The third pulley 3006 and the fourth pulley 3007 are mounted diagonally and symmetrically on either side of the center rear portion of the second cross beam 2008, respectively.

The fifth pulley 3008 and the sixth pulley 3009 are each spaced apart and mounted on the first cross beam 2007.

The seventh pulley 3010 is mounted to the bottom of the second beam 2008 and is located behind the third pulley 3006 or the fourth pulley 3007.

The eighth pulley 3011 is connected to the ninth pulley 3012 mounted above the fifth pulley 3008 and the sixth pulley 3009 spaced apart.

The tenth pulley 3013 is located below the side of the seventh pulley 3010.

Figure 7:
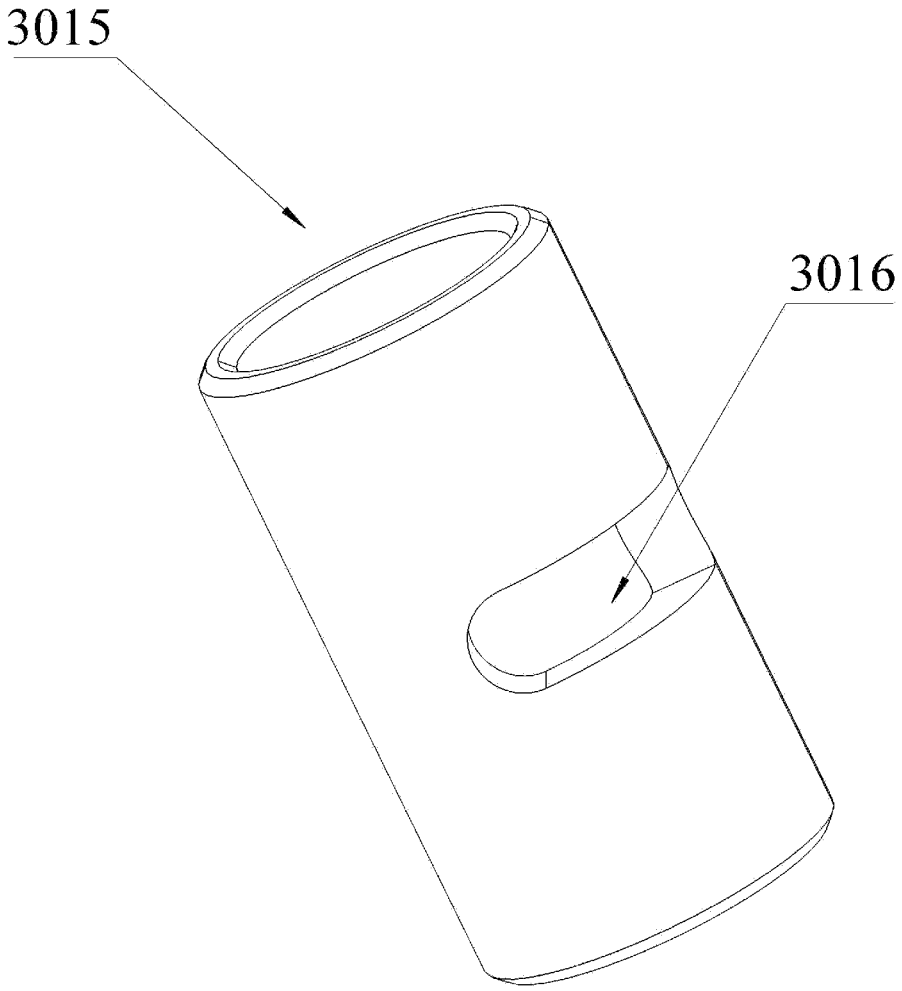
FIG. 7 shows a schematic view of the structure of the connecting shaft.

The connecting shaft 3015 is internally provided with a sliding groove 3016, as shown in FIG. 7, by which the sliding groove 3016 realizes the sliding restriction of the first wire rope 3001 and effectively prevents the first wire rope 3001 from twisting, which affects the use.

By reducing the number of pulleys used and using the pulley assembly in conjunction with a wire rope, it is possible to achieve a variety of fitness movements for the user during a workout, such as a seated pull-down versus a straight-arm press-down.

Figure 8:
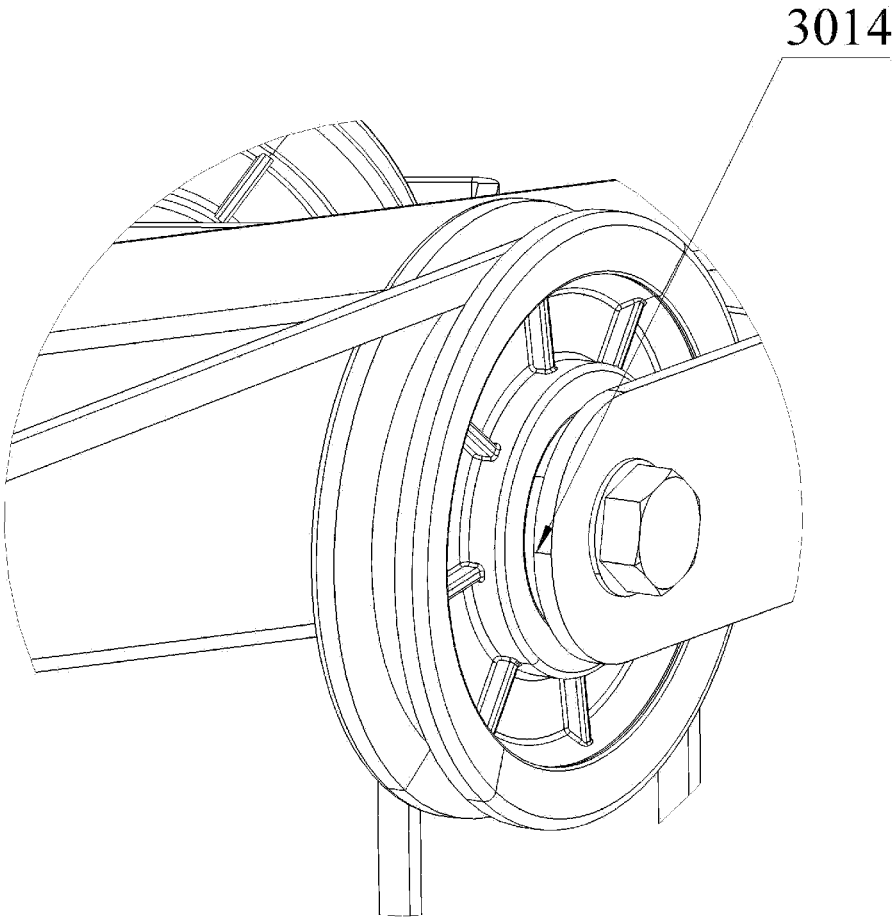
FIG. 8 shows a schematic view of the structure of the pulley assembly.

In this embodiment, the pulley assemblies are all provided with a first bearing 3014, as shown in FIG. 8, by providing the first bearing 3014 the pulley assemblies can be made to move more smoothly, thereby enhancing the user's experience when using the multifunctional fitness equipment 1000.

Figure 9:
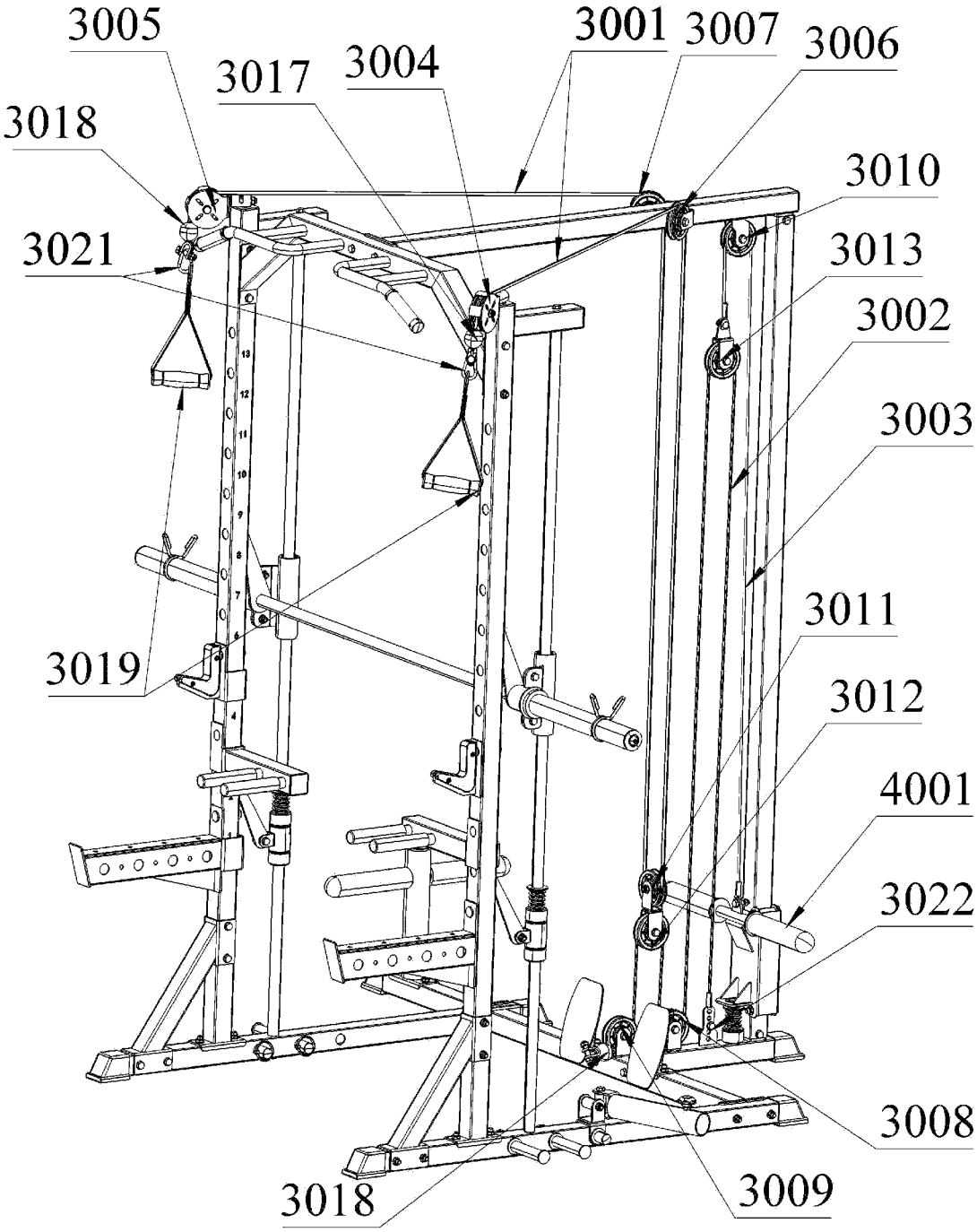
FIG. 9 shows a schematic view of the connection structure of the drive assembly.

In this embodiment, as shown in FIG. 9, the center portion of the first wire rope 3001 is installed around the eighth pulley 3011, one end of which extends upward and around the third pulley 3006 and extends horizontally so as to be installed around the first pulley 3004, and the other end of which extends upward and around the fourth pulley 3007 and extends horizontally so as to be installed around the second pulley 3005. The ends of the first wire rope 3001 are also provided with a first limiting ball 3017 and a second limiting ball 3018, respectively, and the first limiting ball 3017 and the second limiting ball 3018 are used to limit the position of the two ends of the first wire rope 3001, so as to effectively prevent the multifunctional fitness equipment 1000 from slipping off the phenomenon of the first wire rope 3001 when in use.

In this embodiment, the drive assembly 3000 further includes two pullers 3019 wherein, the first limiting ball 3017 and the second limiting ball 3018 are respectively connected to the puller 3019 by snap 3021. The first limiting ball 3017 and the second limiting ball 3018 are removable parts to make the multifunctional fitness equipment 1000 easier to install, and the first wire rope 3001 is pulled by the puller 3019 to make it easy to use.

In this embodiment, one end of the second wire rope 3002 is provided with a third limiting ball 3020, and the other end is connected with a wire rope connection seat 3022. The second wire rope 3002 is wound on the ninth pulley 3012, one end of which extends downwardly to the sixth pulley 3009 and is attached to the third limiting ball 3020. The third limiting ball 3020 is a removable part, which is conveniently installed, but also prevent the end portion of the second wire rope 3002 from slipping off from the sixth pulley 3009. The other end of the second wire rope 3002 extends downwardly to be wound around the fifth pulley 3008, and extends upwardly to be wound around the tenth pulley 3013. Further, the other end of the second wire rope 3002 is connected with the wire rope connection seat 3022, which is mounted on the first cross beam 2007 and is located at the rear end of the fifth pulley 3008, so as to fix the position of the second wire rope 3002, and the movement of the second wire rope 3002 is driven by the first wire rope 3001.

In this embodiment, the third wire rope 3003 is wound around the seventh pulley 3010, one end of which extends upwardly to connect with the tenth pulley 3013, and the other end of which extends downwardly to connect with the trolley bracket 4001. The second wire rope 3002 is used to drive the movement of the third wire rope 3003, so as to cause the third wire rope 3003 to drive the trolley bracket 4001 to slide up and down. During installation, the first wire rope 3001 is first wound and connected to the pulley assembly, then the second wire rope 3002 is wound and connected to the pulley assembly, and finally the third wire rope 3003 is wound and fitted to the pulley assembly, which not only makes the installation more convenient by cooperating and connecting with the pulley assembly, but also reduces the friction between the wire rope and the multifunctional fitness equipment 1000 when it is in use, and prolongs the service life of the multifunctional fitness equipment 1000.

Figure 10:
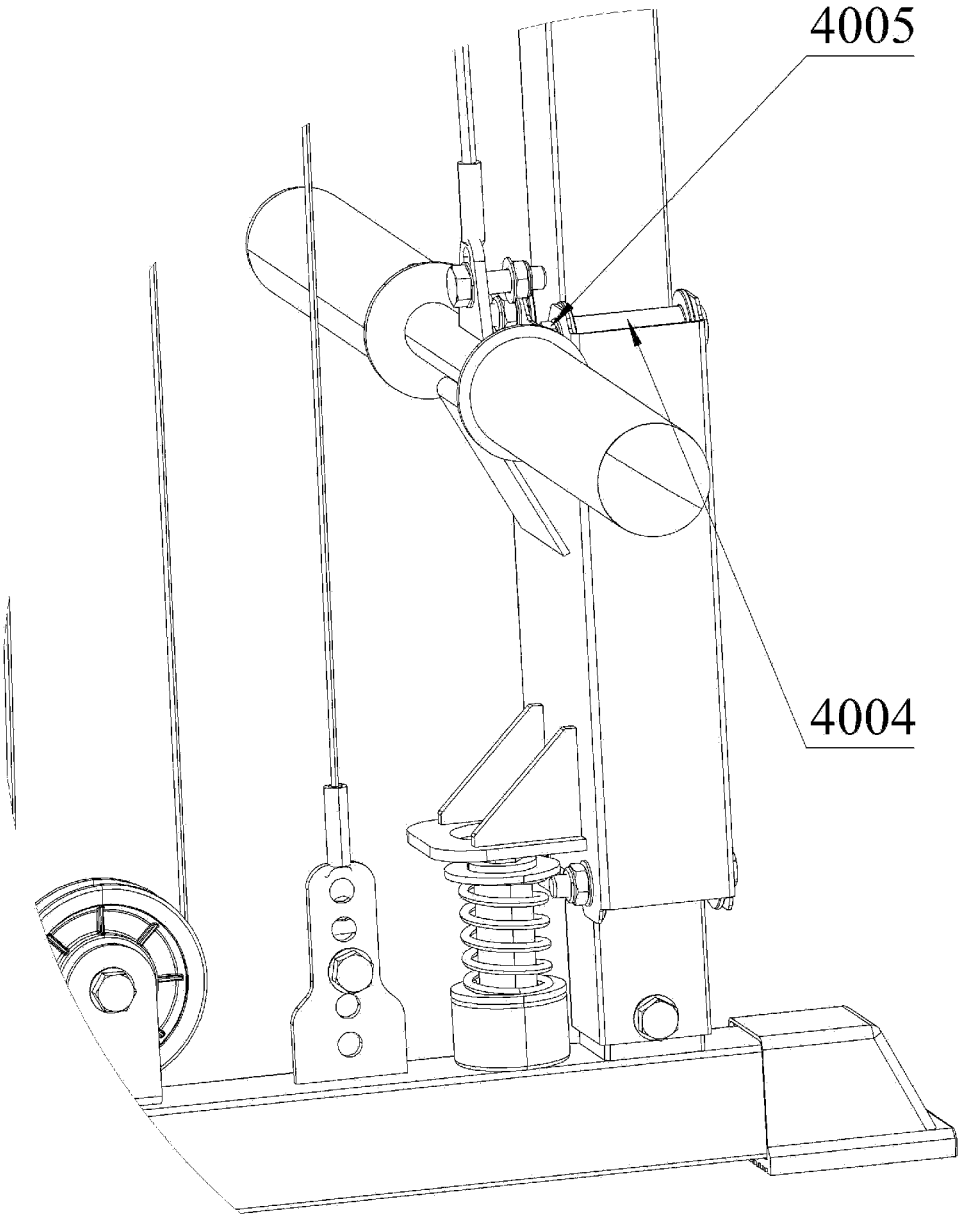
FIG. 10 shows a schematic view of the structure of the roller column.

In this embodiment, the sliding seat 4002 is a hollow rectangular structure mounted around outside of the third column 2009, and at least four roller columns 4004 are mounted on both sides of the upper and lower ends of the third column 2009, as shown in FIG. 10. A second bearing 4005 is provided within each of the at least four roller columns 4004 for smooth rolling. The roller column 4004 slidably cooperate with the third column 2009, and by having at least four roller columns 4004, the sliding friction generated by the trolley bracket 4001 is reduced, when the roller columns 4004 slides along the third column 2009, so as to reduce wear on the multifunctional fitness equipment 1000 and extend the service life of the multifunctional fitness equipment 1000.

In other embodiments (not shown in the figures), the sliding seat 4002 may also be provided in the form of hollow triangles, circles, sectors, and irregular polygons.

Figure 11:
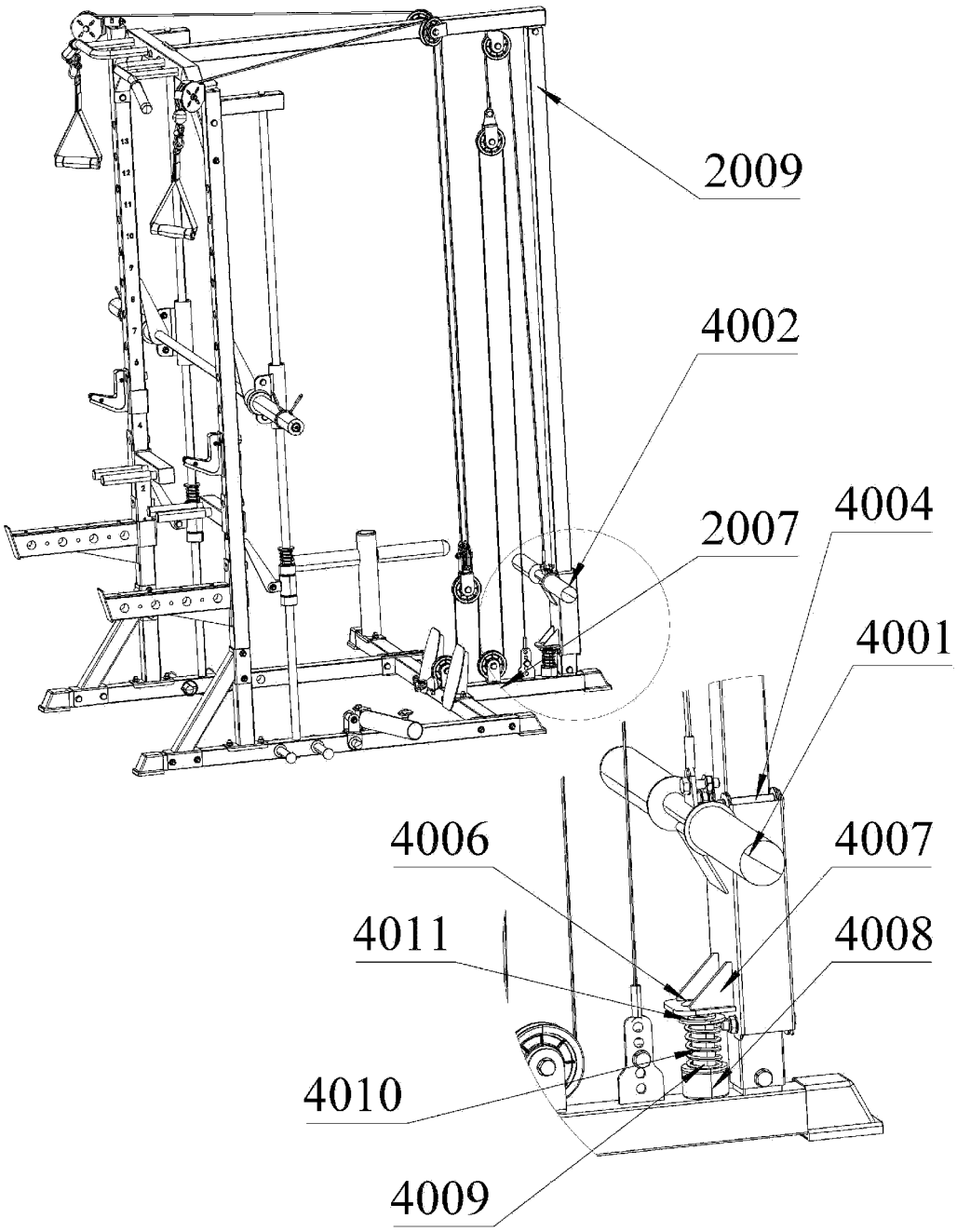
FIG. 11 shows a schematic view of the structure of the trolley bracket.

In this embodiment, as shown in FIG. 11, the sliding seat 4002 is further provided with a limit block 4007. The limit block 4007 is provided with a through-hole 4006, and an elastic limit seat 4003 is provided directly below the limit block 4007. The elastic limit seat 4003 comprising a mounting block 4008, a mounting post 4009, a spring 4010, and a limiting piece 4011, wherein the mounting block 4008 is mounted on the first cross beam 2007. The mounting block 4008 is vertically mounted on an upper end of the mounting post 4009, and the spring 4010 is fitted on the outside of the mounting post 4009 and connected to the limiting piece 4011, wherein the limiting piece 4011 can move up and down with the compression of the spring 4010.

In this embodiment, the limiting piece 4011 is circular and its outer diameter is larger than the inner diameter of the through-hole 4006, which limits the movement of the sliding seat 4002 by the limiting piece 4011, thereby realizing the purpose of pressure cushioning. In other embodiments (not shown in the figures), the limiting piece 4011 may also be rectangular, oval, curved, and irregularly shaped.

Figure 12:
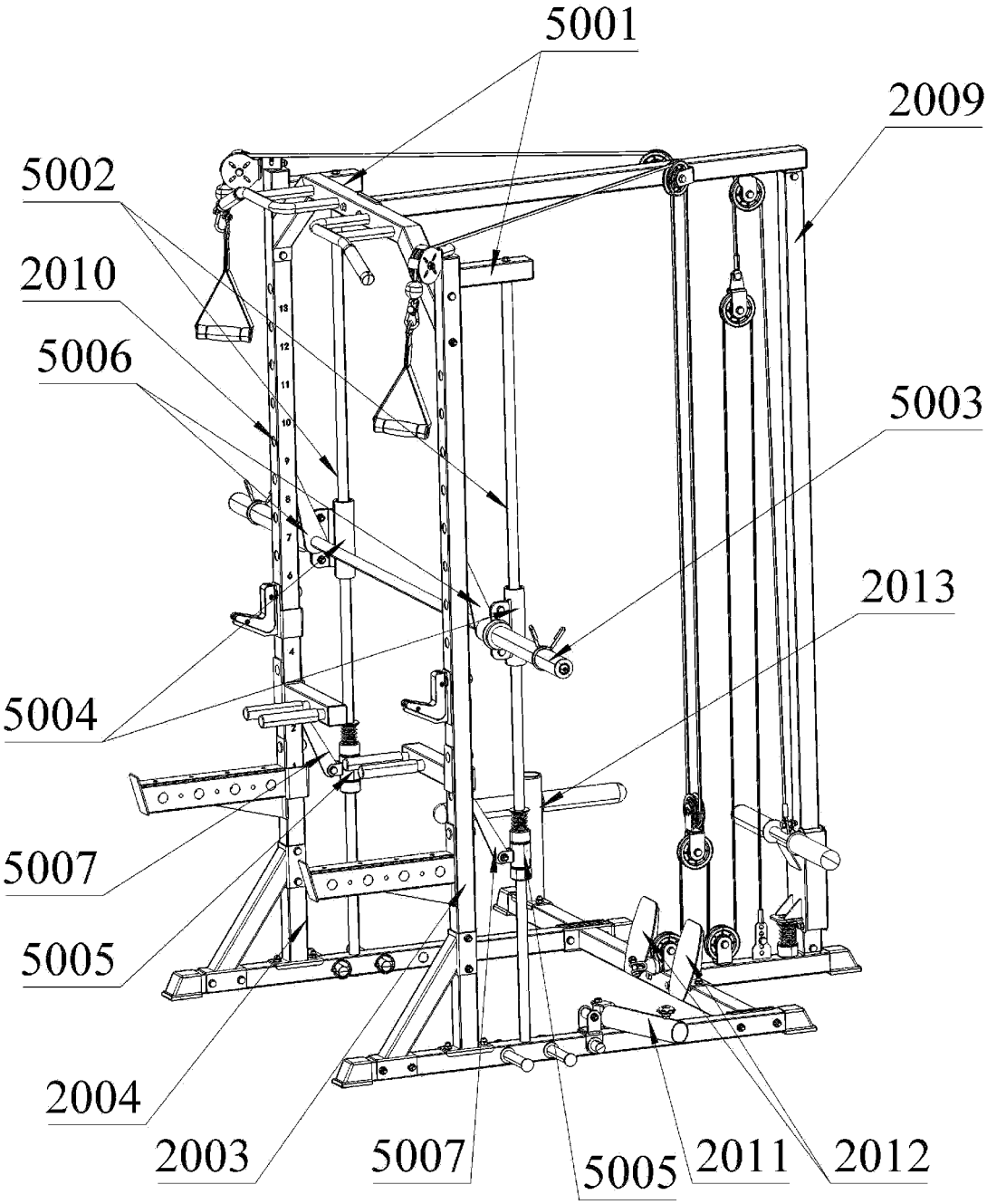
FIG. 12 shows a schematic view of the connection structure of the frame assembly to the smith machine.

In this embodiment, as shown in FIG. 12, the first column 2003 and the second column 2004 are respectively provided with mounting holes 2010. The mounting holes 2010 are arranged in equally spaced rows. The pole mount 5004 cooperates with the mounting holes 2010 through the first positioning hook plate 5006 and is connected to the first column 2003 and the second column 2004. The telescopic positioning seat 5005 cooperates with the mounting holes 2010 through the second positioning hook plate 5007 cooperates with the mounting holes 2010 and is connected to the first column 2003 and the second column 2004. The first positioning hook plate 5006 is used to adjust the height of the pole mount 5004, and the second positioning hook plate 5007 is used to adjust the height of the telescopic positioning seat 5005.

In this embodiment, the gun barrel 2011 is mounted on the base frame 2001. In other embodiments (not shown in the figures), a smith pole 5003 can be inserted into the gun barrel 2011 so as to facilitate doing lifting training. In this embodiment, two pedals 2012 are provided diagonally on the inner side of the connecting rod 2002, so as to facilitate doing paddling training.

In this embodiment, an olympian barrel 2013 is mounted on the connecting rod 2002, and an olympian bar is provided in the olympian barrel 2013, which can facilitate the user to use the olympian bar to do more fitness training.

Figure 13:
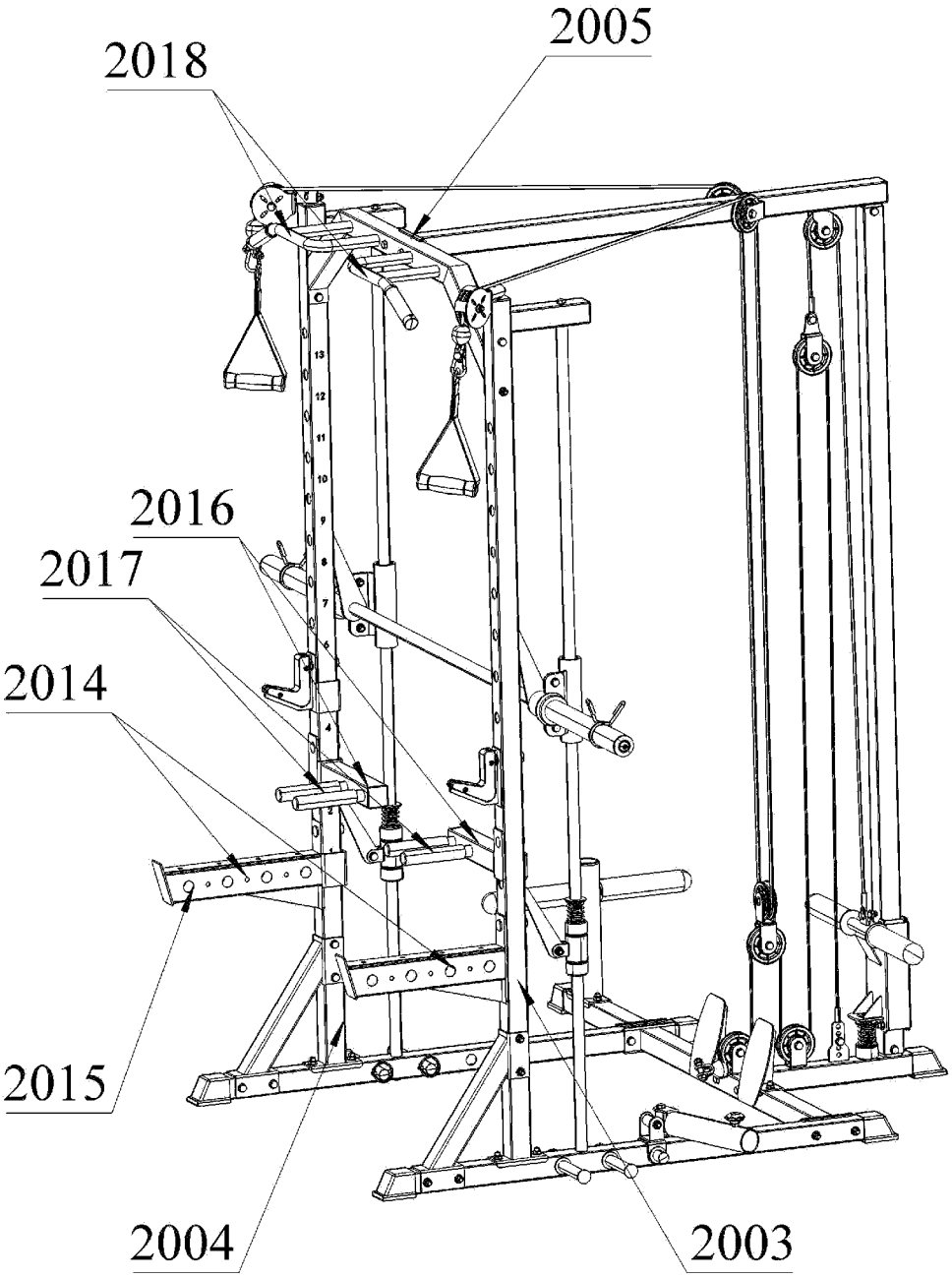
FIG. 13 shows a schematic view of the horizontal front portion of the frame assembly connecting structure.

In this embodiment, as shown in FIG. 13, the first column 2003 and the second column 2004 are each provided with a first side shelf 2014 extending horizontally toward the front, wherein the first side shelf 2014 is provided with a plurality of positioning holes 2015 so as to facilitate doing barbell deep squat training. In other embodiments (not shown in the figures), the first side shelf 2014 may also be provided with positioning pins, so as to do barbell deep squat training.

In this embodiment, the first column 2003 and the second column 2004 are also provided with a second side shelf 2016 on the inner side of each of the first column 2003 and the second column 2004, wherein the second side shelf 2016 is mounted with two cylindrical bars 2017.

In other embodiments (not shown in the figures), the number of the second side shelf 2016 provided on the first column 2003 and the second column 2004 may be any desired, and the number of cylindrical bars 2017 installed on the second side shelf 2016 may also be any as desired.

In this embodiment, the gantry frame 2005 is provided with two handles 2018, wherein the two handles 2018 are symmetrically provided so as to facilitate doing pull-up training.

Figure 14:
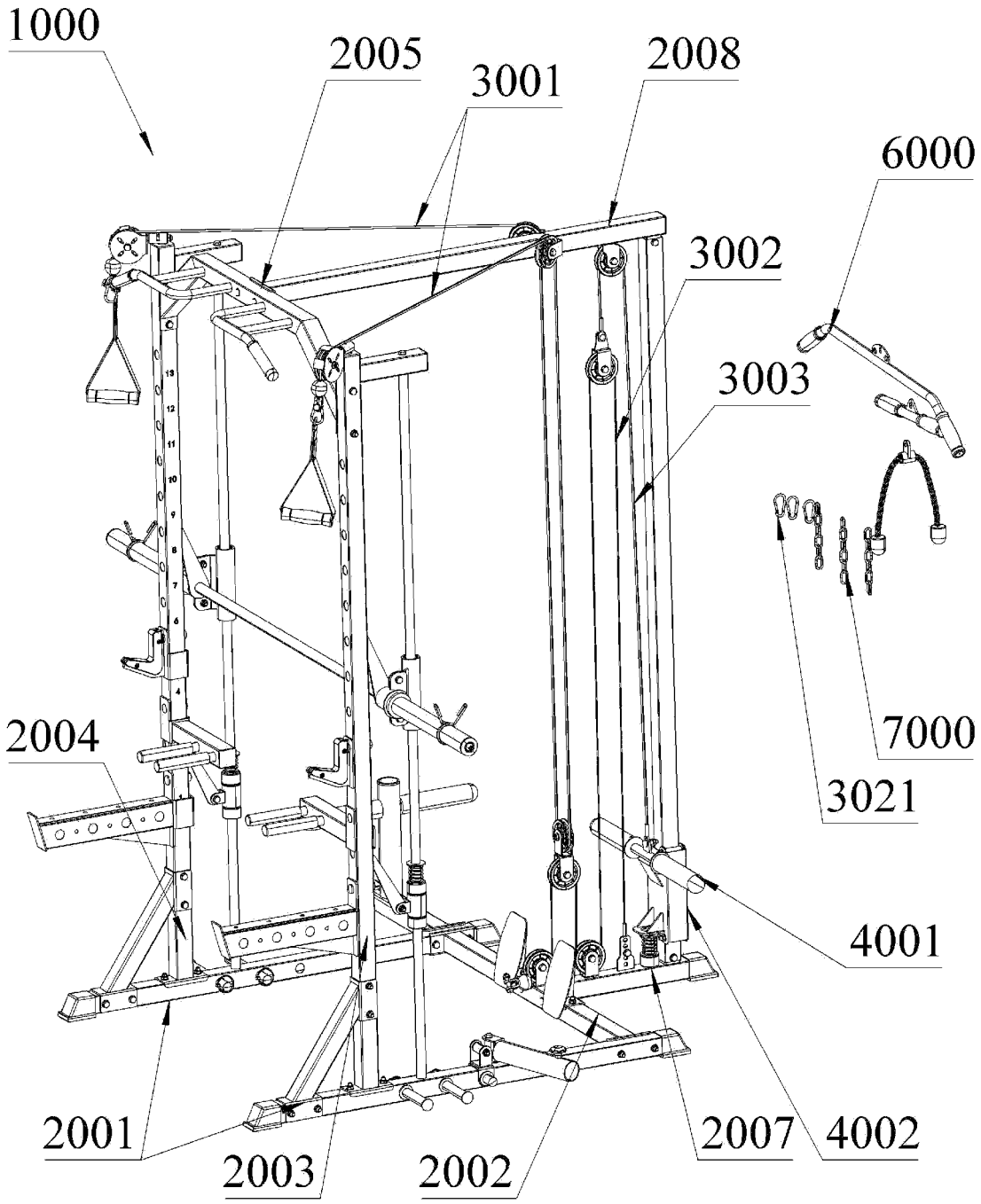
FIG. 14 shows a schematic view of the structure of the pull-up bar and chain of the fitness equipment.

In this embodiment, as shown in FIG. 14, the multifunctional fitness equipment 1000 is further provided with a pull-up bar 6000 and two chains 7000, wherein the chain 7000 is connected to the snap 3021, and the pull-up bar 6000 is connected to the chain 7000 so that the pull-up bar 6000 can be used to complete seated pulldown and arm pulldown training. The two chains 7000 are used in conjunction with each other to facilitate the use of the levers to accomplish the high pull-up flat push-down training. In other embodiments (not shown in the figures), the number of chains 7000 can be any desired.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

The invention has now been described in detail for the purposes of clarity and understanding. However, those skilled in the art will appreciate that certain changes and modifications may be practiced within the scope of the appended claims.

Conditional language used herein, such as, among others, "can," "could," "might." "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

What is claimed:

1. A multifunctional fitness equipment comprising:

a frame assembly, a drive assembly, a slide car, and a smith machine, wherein:

said frame assembly comprises two base frames set opposite to each other on a left and a right of the frame assembly, wherein said two base frames are connected by a connecting rod; said two base frames are provided with a first column and a second column vertically, wherein said first column and said second column are connected by a gantry frame, each of said first column and said second column is respectively connected to said two base frames by a support frame therebetween, said connecting rod is provided with a first cross beam, said gantry frame is provided with a second cross beam, wherein said first cross beam and said second cross beam are set opposite to each other rearwardly of said first and second columns, and a third column extends vertically between said first cross beam and said second cross beam;

said drive assembly includes a pulley assembly, a first wire rope, a second wire rope, and a third wire rope, said first wire rope is connected with said second wire rope and said third wire rope via said pulley assembly, said pulley assembly is connected by said first wire rope to drive movement of said second wire rope and said third wire rope, thereby driving an up and down slide of said slide car, a wire rope alignment path from a center alignment thereof is relatively shorter than from two sides of the wire rope alignment path;

said slide car comprises a trolley bracket, a sliding seat, and an elastic limit seat, said trolley bracket slides up and down along said third column by said sliding seat, and said elastic limit seat is connected to said first cross beam and said sliding seat in order to control a sliding distance of said trolley bracket; and said smith machine comprises a pair of cross bars, a pair of fourth risers, and a smith pole, wherein said pair of cross bars is respectively set adjacent to a rear surface of an upper portion of said first column and said second column, said pair of fourth risers respectively extends vertically between said pair of cross bars and said two base frames, wherein each of said pair of fourth risers is provided with a pole mount and a telescopic positioning seat, and wherein said smith pole is set on and extends horizontally between said pole mounts.

2. The multifunctional fitness equipment according to claim 1, wherein a length of said first cross beam is less than a length of said second cross beam.

3. The multifunctional fitness equipment according to claim 1, wherein said pulley assembly comprises a first pulley, a second pulley, a third pulley, a fourth pulley, a fifth pulley, a sixth pulley, a seventh pulley, an eighth pulley, a ninth pulley, and a tenth pulley, wherein said first through tenth pulleys are all internally provided with a first bearing, said first pulley and said second pulley being mounted obliquely symmetrically on a front surface of an upper end of said first column and said second column, respectively, by a pair of connecting shafts, wherein each said connecting shaft is provided with a sliding groove, said third pulley and said fourth pulley being mounted obliquely and symmetrically on opposing longitudinal side surfaces of said second cross beam, respectively, at a center rear portion thereof, said fifth pulley and said sixth pulley being mounted at intervals on said first cross beam, said seventh pulley being mounted on a bottom surface of said second cross beam and located rearwardly of said third pulley and said fourth pulley, said eighth pulley and said ninth pulley being connected and located above said fifth pulley and said sixth pulley and spaced apart therefrom, and said tenth pulley being located below said seventh pulley.

4. The multifunctional fitness equipment according to claim 3, wherein said first wire rope comprises a first end and a second end opposite said first end, wherein a middle part of said first wire rope is mounted on said eighth pulley, said first end of said first wire rope extends upwardly around said third pulley and extends horizontally around said first pulley, said second end of said first wire rope extends upwardly around said fourth pulley and extends horizontally around said second pulley, and said first wire rope is mounted with a first limiting ball and a second limiting ball respectively on said first and second ends of said first wire rope.

5. The multifunctional fitness equipment according to claim 4, wherein said drive assembly further comprises at least two pullers, said first limiting ball and said second limiting ball being respectively connected to said at least two pullers by a snap, said first wire rope configured to be pulled by a user by said at least two pullers.

6. The multifunctional fitness equipment according to claim 4, wherein said second wire rope comprises a first end and a second end opposite said first end, and wherein said first end of said second wire rope is connected with a third limiting ball and said second end is connected with a wire rope connection seat.

7. The multifunctional fitness equipment according to claim 6, wherein said second wire rope is wound around said ninth pulley, said first end of said second wire rope extends downwardly around said sixth pulley and is connected to said third limiting ball, said second end of said second wire rope extends downwardly around said fifth pulley and upwardly around said tenth pulley, and is connected to said wire rope connection seat, said wire rope connection seat being mounted on said first cross beam and located rearwardly of said fifth pulley.

8. The multifunctional fitness equipment according to claim 3, wherein said third wire rope comprises a first end and a second end opposite said first end, and wherein said third wire rope is wound around said seventh pulley, said first end of said third wire rope extends downwardly to be connected to said tenth pulley, said second end of said third wire rope extends downwardly to be connected to said trolley bracket, and is driven by said second wire rope to drive said third wire rope, which then drives said trolley bracket to slide up and down.

9. The multifunctional fitness equipment according to claim 3, wherein said sliding seat is a hollow rectangular structure wrapped around an exterior of said third column, with roller columns mounted on each side of upper and lower ends of said sliding seat for sliding and cooperating with said third column, and by said roller columns said trolley bracket is driven to slide along said third column.

10. The multifunctional fitness equipment according to claim 9, wherein each said roller column is provided with a second bearing.

11. The multifunctional fitness equipment according to claim 9, wherein a through-hole is provided with said sliding seat, wherein said through-hole is provided with a limit block.

12. The multifunctional fitness equipment according to claim 11, wherein said elastic limit seat is located directly below said limit block and includes a mounting block, a mounting post, a spring and a limiting piece, said mounting block being mounted to said first cross beam, said mounting post being vertically mounted to an upper end of said mounting block, said spring being set on an outside of said mounting post and connected to said limiting piece.

13. The multifunctional fitness equipment according to claim 12, wherein said limiting piece is circular and has an outer diameter not less than an inner diameter of said through-hole.

14. The multifunctional fitness equipment according to claim 1, wherein said first column and said second column are provided with equally spaced rows of mounting holes, each said pole mount is respectively mated with said equally spaced rows of mounting holes by a first positioning hook plate, and is respectively connected to said first column and said second column, each said telescopic positioning seat cooperating with said equally spaced rows of mounting holes by a second positioning hook plate, and respectively connected to said first column and said second column.

15. The multifunctional fitness equipment according to claim 1, wherein any one of said two base frames is fitted with a gun barrel, said gun barrel being configured for said smith pole to be insertable thereinto.

16. The multifunctional fitness equipment according to claim 1, wherein two pedals are mounted diagonally on an inside of said connecting rod, said connecting rod is provided with an olympian barrel at an outer end thereof, said olympian barrel being provided with an olympian bar therein.

17. The multifunctional fitness equipment according to claim 1, wherein said first column and said second column are each provided with a first side shelf extending horizontally outward from a front surface of each of said first column and said second column, respectively, and each said first side shelf is provided with a plurality of positioning holes.

18. The multifunctional fitness equipment according to claim 17, wherein an inner side surface of each of said first column and said second column is respectively provided with an oppositely disposed second side shelf, each said second side shelf being mounted with at least one cylindrical bar.

19. The multifunctional fitness equipment according to claim 1, wherein two handles are symmetrically provided on said gantry frame.

20. The multifunctional fitness equipment according to claim 1, further comprising a lat pulldown bar and two chains, wherein each said chain is coupled to a snap, wherein said lat pulldown bar is coupled to at least one of said two chains.

* * * * *